US007410165B2

(12) United States Patent
Knierim et al.

(10) Patent No.: US 7,410,165 B2
(45) Date of Patent: Aug. 12, 2008

(54) SYSTEMS AND METHODS FOR MULTI-PICK DETECTION

(75) Inventors: David L. Knierim, Wilsonville, OR (US); Mark H. Cowan, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 356 days.

(21) Appl. No.: 10/869,889

(22) Filed: Jun. 18, 2004

(65) Prior Publication Data

US 2005/0280204 A1 Dec. 22, 2005

(51) Int. Cl.
*B65H 7/02* (2006.01)

(52) U.S. Cl. ..... 271/263; 271/265.04

(58) Field of Classification Search ..... 271/265.04, 271/262, 263

See application file for complete search history.

(56) References Cited

U.S. PATENT DOCUMENTS 6,000,693 A * 12/1999 Tranquilla ..... 271/263
7,052,008 B2 * 5/2006 Mitsuya et al. ..... 271/122

* cited by examiner

*Primary Examiner*—Kaitlin S Joerger
(74) *Attorney, Agent, or Firm*—Oliff & Berridge, PLC

(57) ABSTRACT

Detecting a multi-pick in a nip of a media feed mechanism, includes determining a limit of a property of a media feed mechanism that is related to the kinetic properties of one or more rollers that form a nip; monitoring the property of the media feed mechanism; determining a maximum value of the of the monitored property; comparing the maximum value to the limit; and determining, if the maximum value exceeds the operational limit, that a multi-pick has occurred.

25 Claims, 5 Drawing Sheets

SYSTEMS AND METHODS FOR MULTI-PICK DETECTION

BACKGROUND OF THE INVENTION

1. Field of Invention

This invention relates to systems and methods for detecting multiple sheets of media that are picked up and fed by a media feed mechanism.

2. Description of Related Art

Conventional media feed mechanisms, such as those found in image reproduction devices, for example, printers, copiers, and facsimile machines, typically are used for transporting sheets of media such as, for example, paper, card stock, envelopes, transparencies, labels, or any other media (hereinafter "sheets"). These types of media feed mechanisms pick up one sheet from a media cassette or other media storage device and feed that sheet to an image reproduction portion of the image reproduction device and then to a media output portion of the media reproduction device.

Occasionally, the media feed system will pick up multiple sheets at substantially the same time (hereinafter a "multi-pick"), rather than the desired single sheet, and transport the multiple picked up sheets to the image reproduction portion. One sheet of the multiple sheets is usually ahead of the other sheet(s) by, for example, a few to many millimeters. The trailing picked up sheet(s) can cause damage to the image reproduction device and particularly the image reproduction portion if it wraps around, for example, a print drum or fuser roller and/or contacts a print head.

SUMMARY OF THE INVENTION

Conventional image reproduction devices attempted to prevent multi-picks by using stripper blades or fingers. Typically, stripper blades are used to strip the (normally single) sheet of media off of, for example, an imaging drum, and/or fuser roller at the exit side of the nip. If a multi-pick occurs, and the trailing picked up sheet is on the side of the stripper blade, then the stripper blade may remain down long enough to strip only the lead sheet, allowing the trailing sheet to wrap around the drum or roller underneath the stripper blade. Alternatively, when a stripper blade or finger remains in contact with a sheet long enough to prevent a multi-pick, i.e. to strip the lead sheet and trailing picked up sheet, the stripper blade or finger is likely to become contaminated with ink. The ink which has contaminated the stripper blade or finger can thus be re-deposited on a subsequent sheet and thereby degrade print quality.

In light of the above described problems, methods have been proposed in which a dedicated detection device usable to detect a plurality of sheets within a media feed mechanism, such as a reflective optical sensor, is included as part of the media feed mechanism and/or image reproduction device in order to optically detect a multi-pick and interrupt the media feed mechanism before the multi-picked sheets can cause damage. However, the inclusion of a separate dedicated multi-pick detection device would substantially increase the production and maintenance costs of the media feed mechanisms and/or image reproduction devices. Furthermore, optical detection devices, such as reflective optical sensors, are substantially incapable of detecting transparent media, such as transparencies for use with overhead projectors or document overlays.

Therefore, various exemplary embodiments of this invention detect a multi-pick without having to utilize a scraper or finger in a manner that will likely degrade image quality. Furthermore, various exemplary embodiments of the invention detect a multi-pick without the use of devices or systems dedicated solely to the detection of multi-picks that would render the resulting media feed mechanism and/or image reproduction device cost prohibitive with respect to production and/or maintenance.

Various exemplary embodiments of the invention thus monitor various kinetic properties of existing hardware within a media feed mechanism, on the assumption that a multi-pick will affect the physical motion of one or more portions of the existing hardware within the media feed mechanism. The term "kinetic" as used herein is defined as "of, relating to, or produced by motion." Various kinetic properties may include, for example, torque, acceleration, speed, displacement, distance, and/or the force or energy required to produce the torque, acceleration, speed, displacement, and/or distance.

Accordingly, various exemplary embodiments of this invention provide a method for detecting a multi-pick in a nip of a media feed mechanism, including determining a limit of a property of a media feed mechanism that is related to the kinetic properties of one or more rollers that form a nip; monitoring the property of the media feed mechanism; determining a maximum value of the monitored property; comparing the maximum value to the limit; and determining, if the maximum value exceeds the limit, that a multi-pick has occurred.

Various exemplary embodiments of the invention provide a system for detecting a multi-pick including a data sampling circuit, routine, or application that accesses a data stream containing values representing kinetic properties of one or more rollers that form a nip and outputs sampled values that are sampled from the data stream at a predetermined sampling rate, and a data analyzing circuit, routine, or application that accesses the sampled values, analyzes the sampled values, and predicts whether a multi-pick has occurred.

BRIEF DESCRIPTION OF THE DRAWINGS

Exemplary embodiments of the invention will now be described with reference to the accompanying drawings, wherein.

DETAILED DESCRIPTION OF EXEMPLARY EMBODIMENTS

Figure 1:
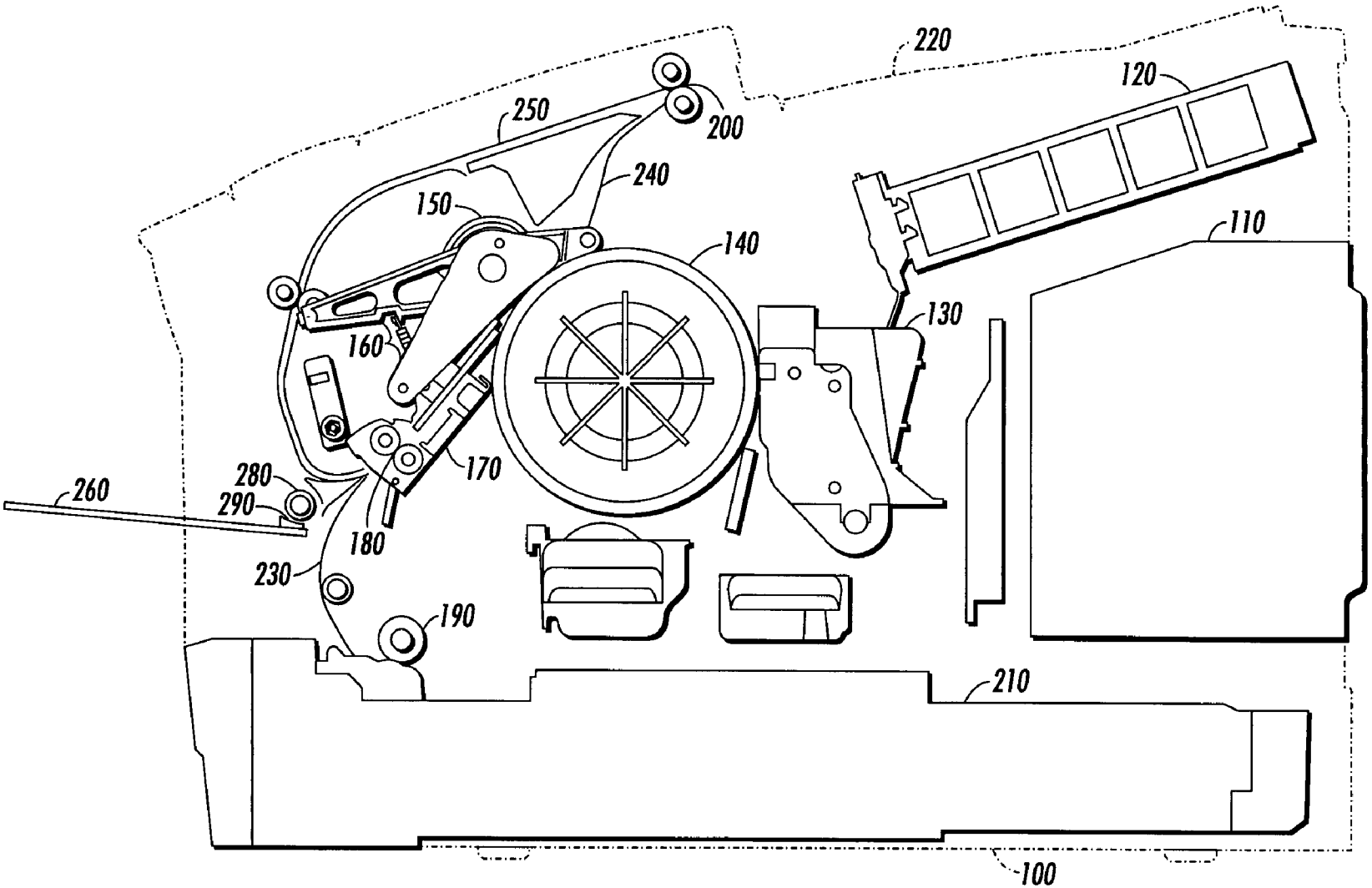
FIG. 1 shows a schematic of an exemplary image reproduction device.
Figure 2:
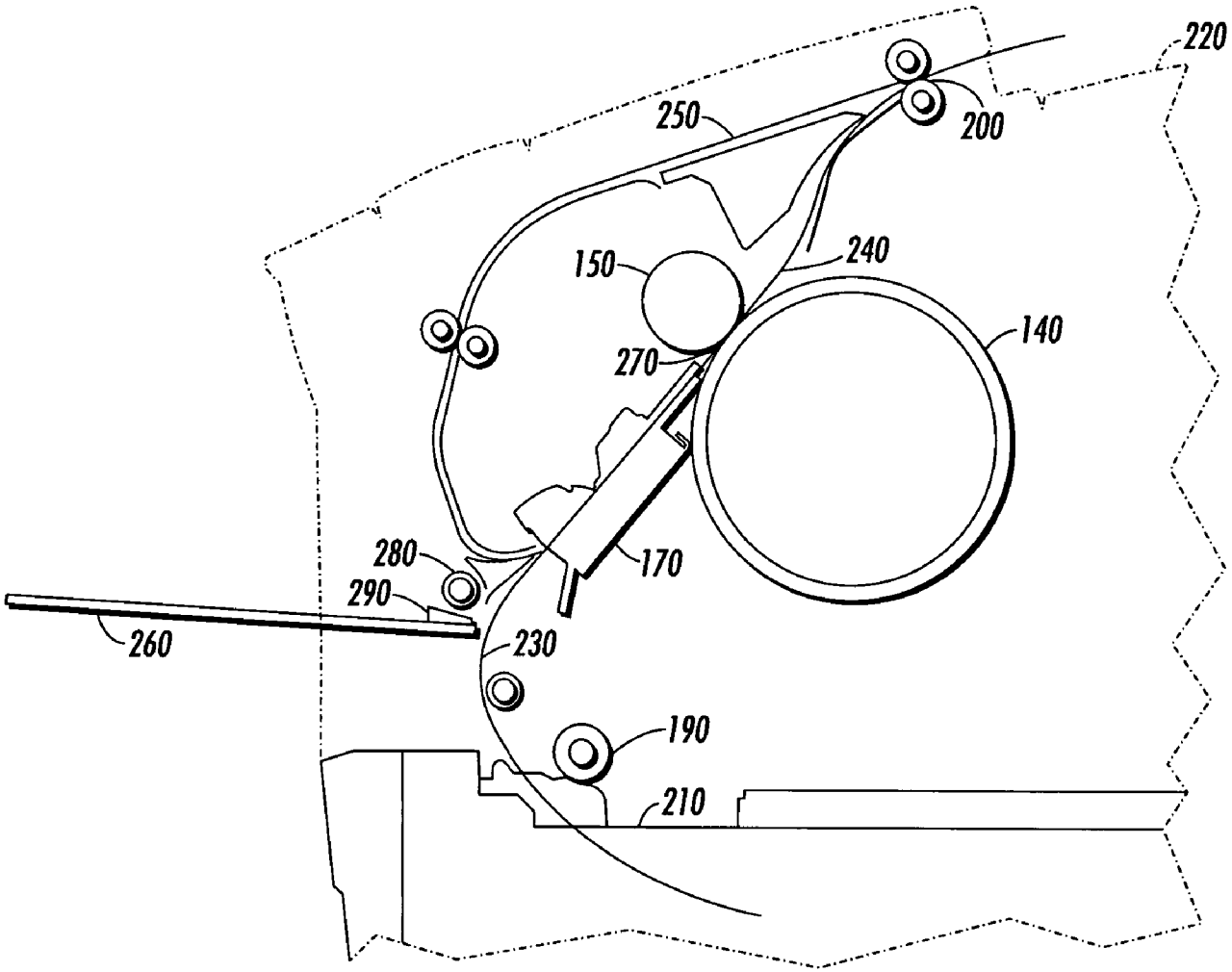
FIG. 2 shows a detailed view of the media path through the exemplary image reproduction device.
Figure 3:
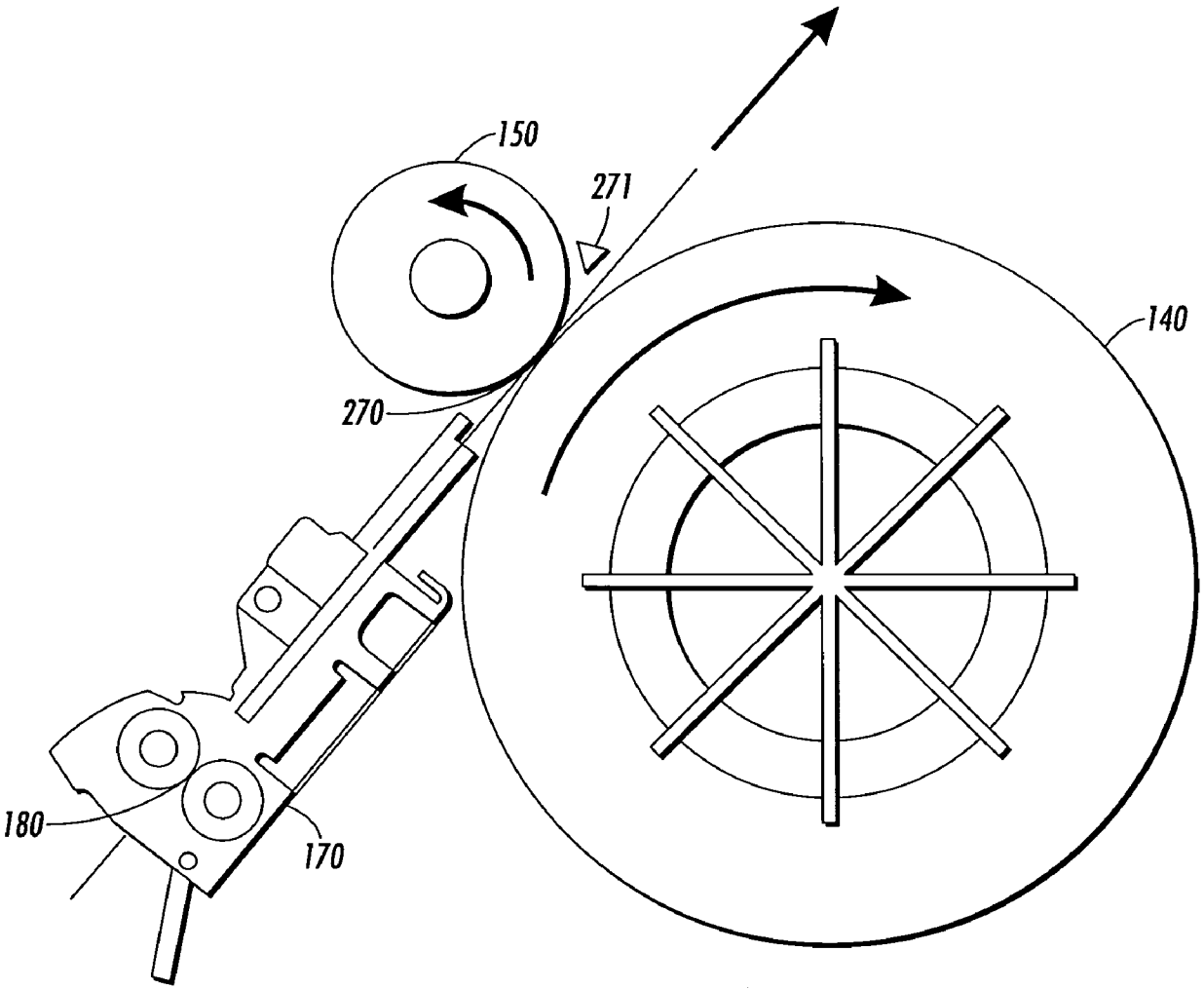
FIG. 3 shows a detailed view of the transfer nip of the exemplary image reproduction device.

For a general understanding of an image reproduction device, such as, for example, an electrophotographic printer, a solid ink printer, an ink-jet printer, a facsimile machine, or a copying machine, in which the features of this invention may be incorporated, reference is made to FIG. 1-3. FIG. 1 shows a schematic of the various key components of an exemplary image reproduction device. FIGS. 2 and 3 show various features of the image reproduction device in more detail. Although the various exemplary embodiments of this invention for detecting a multi-pick are particularly well adapted for use in such a machine, it should be appreciated that the following exemplary embodiments are merely illustrative. Rather, aspects of various exemplary embodiments of this invention may be achieved in any media feed mechanism and/or image reproduction device containing at least one nip region for transporting media that may be subject to a multi-pick formed by a plurality of rollers or by at least one roller and a surface.

As shown in FIG. 1, the image reproduction device 100 includes a controller 110, an ink loader 120, a print head 130, an image drum 140, an image drum motor (not shown), a transfer roller 150, a transfer roller loading mechanism 160, a media preheater 170, a deskew nip 180, a pick roller 190, a media exit nip 200, a main media tray 210, a media output tray 220, a multi-purpose media tray 260, a pick roller 280, and a pad 290. According to the exemplary image reproduction device 100 shown in FIG. 1, a sheet stored in the main media tray 210 is picked by the pick roller 190, transported via an entrance path 230, deskewed by the deskew nip 180, and preheated by the media preheater 170. Then, the sheet enters the transfer nip 270 (see FIG. 3) formed by the transfer roller 150 and the image drum 140 where marking material is transferred onto the media by the image drum 140. Next, the sheet is transported via an exit path 240, through the media exit nip 200 into the media output tray 220.

If an image is to be marked on both sides of the sheet, the sheet does not entirely exit the media exit nip 200, but is pulled back by the media exit nip 200 and transported via the duplex media path 250 to re-enter the deskew nip 180 such that the non-marked surface of the sheet will face the image drum 140.

When sheets of media within the main media tray 210 are used, a pick roller 190 picks up a sheet by "rolling" it off the top of a stack of sheets in the main media tray 210. The stack of sheets are pressed against the pick roller 190, by a spring or pad (not shown) within the main media tray 210 or some other device. The pick roller 190 is then rotated while in contact with the top sheet. The frictional force between the pick roller 190 and the top sheet causes the top sheet to be drawn off of the stack of sheets and transported by the rotation of the pick roller 190.

A sheet may also enter the deskew nip 180 from the multi-purpose media tray 260, shown in FIGS. 1 and 2. Typically, a sheet or sheets are placed in the multi-purpose tray 260. The sheet or sheets are pressed against a pick roller 280, by a pad 290, spring, or similar device. The pick roller 280 picks up a sheet by "rolling" it off the top of the multi-purpose media tray 260 or off the top of the stack of sheets in the multi-purpose media tray 260. The pick roller 280 is then rotated while in contact with the top sheet. The frictional force between the pick roller 280 and the top sheet causes the top sheet to be drawn off of the stack of sheets, or the tray 260, and transported along the entrance path 230 to the deskew nip 180 by the rotation of the pick roller 280.

As discussed above, in a conventional image reproduction device it is conceivable that a plurality of sheets will be picked up by the pick roller 190, 280 and be transported via the entrance path 230 to the deskew nip 180. A multi-pick is usually the result of an attractive force, such as friction or static electricity, causing a second sheet directly below the top sheet in the media tray 210, 260 to be forcibly coupled to the top sheet. When the top sheet is drawn off of the stack of sheets, the attractive force between the top sheet and the second sheet causes the second sheet to be drawn off of the stack of media as well. By virtue of the, for example, slippage between the top sheet and the second sheet due to the relative strength of the frictional or static connection between the top sheet and the second sheet, the leading edge of the second sheet is typically a distance behind the leading edge of the top picked sheet along the media entrance path 230. It should be appreciated that additional sheets may be picked up as well due to an attractive force between the additional picked up sheets and a sheet directly above each additional picked up sheet.

As a result of the multi-pick, the picked up sheets travel through the deskew nip 180 (only the first sheet being deskewed because its leading edge is ahead of the remaining sheets) and enter the transfer nip 270. When the sheets were picked up from the main media tray 210, the picked up top sheet, is on the drum 140 side of the other sheets by virtue of the curve in the entrance path 220. When the sheets were picked up from the multi-purpose media tray 260, the picked up top sheet, is on the transfer roller 150 side of the other sheets.

In either case, the picked up top sheet enters the transfer nip 270 first, and continues along the exit path 240 towards the output tray. Usually, one or more of the remaining sheets, by virtue of trailing the picked sheet, are not properly directed towards the exit path 240, and get stuck within the media feed mechanism causing what is commonly referred to as a "jam."

When the plurality of sheets were multi-picked from the multi-purpose tray, this type of jam can be particularly problematic since the trailing sheet(s) can adhere to, or otherwise follow the image drum 140 and wrap around the image drum 140. The one or more sheets that wrap around the image drum 140 can contact the print head 130 causing damage to the print head 130.

Accordingly, various exemplary embodiments of this invention detect a multi-pick and interrupt the transportation of media shortly after the multi-picked sheets enter the transfer nip 270. Therefore, the transportation of the multi-picked sheets is interrupted before a jam occurs and/or the print head 130 or any other part of the image reproduction device 100 can be damaged.

Figure 4:
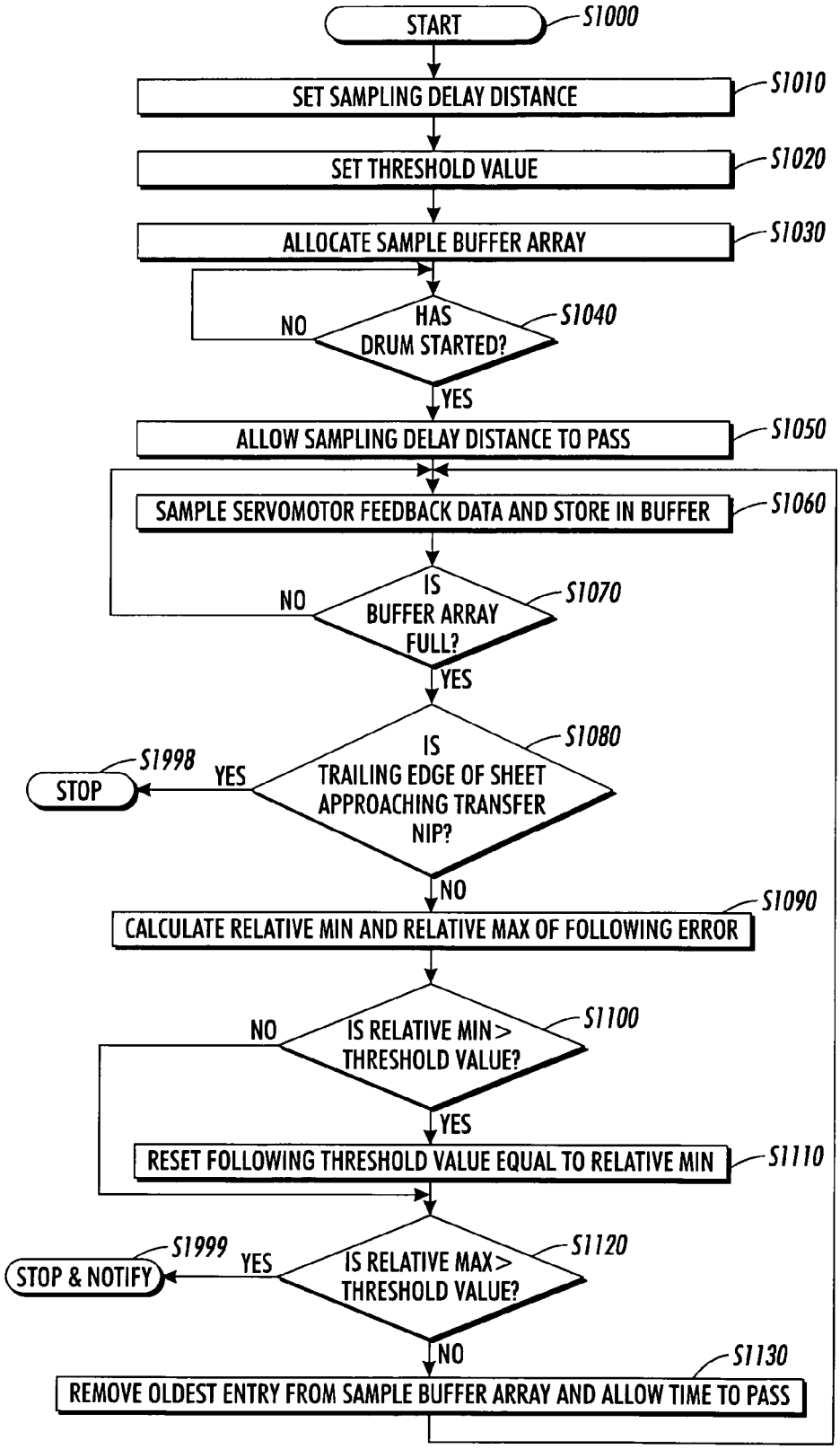
FIG. 4 shows a flowchart outlining an exemplary embodiment of a method for detecting a multi-pick according to the invention.

FIG. 4 shows a flowchart outlining one exemplary embodiment of a method for detecting a multi-pick according to the invention. According to this exemplary embodiment, the kinetic property of the one or more rollers that form a nip being monitored is the torque required to drive the drum 140 that forms part of the transfer nip 270. However, as discussed above, any kinetic property that is effected by a multi-pick may be used.

In this exemplary embodiment, the torque required to drive the drum 140 is determined by feedback provided by the drum motor (not shown). This is because, according to this exemplary embodiment, the drum 140, that forms part of the transfer nip 270 is driven by a servomotor. Typically, media feed mechanisms utilize servomotors in the vicinity of the drum 140. Servomotors allow a controller, for example, controller 110, to maintain a substantially constant velocity of a sheet through the portion of the media feed mechanism driven by the servomotor. If a substantially constant velocity is not maintained near the drum 140, image defects may result.

The drum servomotor is controlled by a feedback loop. The servomotor provides data (feedback) to the controller 110 that is related to the actual motion of the motor. Based on this feedback, the controller is able to make corrections to the servomotor to, for example, maintain a substantially constant velocity of the drum. The feedback data provided by the servomotor is typically expressed as, or converted to an increase or decrease relative to a target value. The data may include for example a rotational position of the servomotor, a velocity of the servomotor, a current required to drive the servomotor, or any other kinetic property of the servomotor (each useable to calculate torque). The data provided by the digital feedback loop thus provides a controller of the servomotor, for example, controller 110, with data that may be used to determine the torque required to drive the drum 140.

When a second sheet, due to a multi-pick, enters the transfer nip 270, that second sheet increases the torque required to drive the drum 140 because the transfer roller 150 and/or drum 140 must now pass two sheets through the transfer nip. The additional thickness of the second sheet that must pass through the transfer nip 270 causes the transfer nip 270 to open (causes the transfer roller 150 to move away from the drum 140) by a distance roughly equal to the thickness of the second sheet. Opening the transfer nip 270 against the spring force trying to keep it closed requires energy, which comes from additional torque. Depending on the type of digital feedback loop controlling the drum servo motor, data representing the increased torque is fed back to the controller 110, or data that may be used to calculate the increased torque (for example, displacement, following error, velocity, and/or electrical current used) is fed back to the controller 110.

As shown in FIG. 4, operation of the method begins in step S1000. Then in step S1010, a sampling delay distance is set. According to various exemplary embodiments of the invention, the sampling delay distance is a distance that a sheet will travel through the transfer nip 270 (i.e., a certain rotational distance of the drum 140) before following error sampling begins. The sampling delay distance skips over or ignores any spikes in the following error that might occur as the motion of the drum 140 and transfer roller 150 starts. For instance, a spike in the following error may be caused by the transfer roller 150 and/or media becoming temporarily deformed when the transfer roller loading mechanism 160 is loaded, or by an initial seam at the leading edge of an envelope or label.

In various exemplary embodiments, the sampling delay distance is set at around 10 mm. However, in various other exemplary embodiments the sampling delay distance may be increased or decreased as necessary to more accurately predict a multi-pick depending on for example, the type of media, the size of the media, whether the media has seams, and/or the location of seams on the media.

It should be appreciated that, in various exemplary embodiments, a stripper blade or finger 271 (see FIG.3) may be kept down until the sampling delay distance passes in order to strip any multi-picks that might otherwise enter the nip while the sampling delay distance passes. However, the sampling delay distance is typically short enough that no marking material will contaminate the stripper blade or finger.

Then, in step S1020, a threshold value is set. According to this embodiment, the threshold value is a maximum allowable increase over a baseline amount of a data value related to torque provided by the feedback loop. As discussed below, if the threshold value is exceeded, it is determined that a multi-pick has occurred. According to various exemplary embodiments, the threshold value is related to the expected marking material thickness to be deposited on the sheet. For instance, when it is necessary for an image reproduction device to lay down thicker marking material layers, such as marking on a transparency, a larger threshold value would be set than when it is necessary to lay down thinner marking material layers. This is because the thicker marking material layers will require a larger torque on the drum 140 to allow the transfer roller 150 and/or drum 140 to pass the marked portions of the sheet through the transfer nip 270. A higher threshold value will decrease the likelihood that an increase in torque that is the result of marking material thickness will be considered a multi-pick, while a lower threshold value will decrease the likelihood that a multi-pick will be ignored as an increase in torque caused by the marking material.

Therefore, in various exemplary embodiments of the invention, the threshold value, may be adjusted according to predicted marking material thickness based on, for example, media type and/or marking settings. Alternatively, according to various other exemplary embodiments, the actual marking material thickness may be determined by, for example, an optical sensor, or marking material output sensor, or preferably by examining the image data (pixels per unit area) as (or before or after) the image is deposited on the drum 140, since this method requires substantially no additional components or cost.

In step S1030, a sample buffer array is allocated long enough to hold samples of the data related to torque provided by the feedback loop of the drum servomotor for a predetermined distance of a sheet that will be transported through the transfer nip 270. In various exemplary embodiments, the array size is calculated based on this predetermined distance, the speed with which the sheet will travel through the transfer nip 270, and a sample rate according to the following relationship:

$$A = \frac{D \times R}{S} \tag{1}$$

where A represents the array size, D represents the predetermined distance, S represents the travel speed, and R represents the sample rate.

In step S1040, a determination is made whether the motion of the drum 140 has started. If the drum 140 has started, operation continues to step S1050. If the drum 140 has not started, operation returns to step S1040 (i.e., the drum 140 is monitored for startup). In step S1050, the sampling delay distance worth of drum 140 rotation is allowed to pass. Operation continues to step S1060.

In step S1060, the data provided by the feedback loop is read and stored in the buffer array. As discussed above, in various other exemplary embodiments, any other kinetic property of the transfer roller 150, the drum 140, the nip 270, and/or the drum servomotor that is effected by a multi-pick may be read and stored in the buffer array. For instance, in various other exemplary embodiments, the drum motor current may be provided by the feedback loop or otherwise monitored and stored in the buffer array. Because the increase in torque necessary to pass a multi-pick through the transfer nip 270 must be supplied by the motor, the motor will draw additional current in order to supply the increased torque. Additionally, a displacement of the transfer roller 150 with respect to the drum 140 may be monitored. As additional picked up sheets pass through the nip, the transfer roller 150 will be displaced away form the drum 140.

Next, in step S1070, a determination is made whether the buffer is full. If the buffer is full, according to various exemplary embodiments, there is ample data stored in the buffer to begin to determine whether a multi-pick has occurred and operation continues to step S1080. If the buffer is not full, operation returns to step S1060.

In step S1080, a determination is made whether the end of the sheet is approaching the transfer nip. In order to determine whether the end of the sheet is approaching the transfer nip 270, various exemplary embodiments of the invention include a media sensor (not shown) that is placed a predetermined distance upstream of the transfer nip and that detects the presence of media. When the trailing edge of a sheet passes the media sensor, the sensor will no longer detect the sheet, thereby indicating that the trailing edge of the sheet is approaching the transfer nip 270.

When the trailing edge of a sheet is approaching the transfer nip 270 a substantial portion of the media has already passed through the transfer nip 270. Accordingly, it is very unlikely that a multi-pick will occur. However, many false multi-pick detections may occur near the trailing edge of a sheet. For instance, many envelopes have a seam near the end of the envelope that will cause an increase in servo following error. In various exemplary embodiments, the media sensor may be placed, for example, at or near the deskew nip 180, since, in many media feed mechanisms, the deskew nip 180 is typically just downstream of the transfer nip 270. However, any other pre-existing media sensor upstream of the transfer nip, but closer to the nip than the length of the shortest media, will suffice.

Accordingly, in order to prevent a false detection of a multi-pick, in step S1080, if the trailing edge of the sheet is approaching the transfer nip 270, operation of the method jumps to step S1998 where operation of the method ends. It should be appreciated that the method represented by the flowchart shown in FIG. 4 is only for one sheet. Therefore, the entire method is restarted for each sheet in a multi-sheet job. Because a multi-sheet job may contain different settings and different media types, this allows for each sheet to be treated differently. Based on, for example, the different settings and media types, each sheet might have, for example, a different sampling delay distance, a different threshold value, and/or a different sample buffer array size.

However, it should be appreciated that, in various other exemplary embodiments, the method may be applied to an entire multi-sheet job, wherein the various steps shown in FIG. 4 are looped through until the multi-sheet job is complete.

In step S1080, if the trailing edge of the sheet is not approaching the transfer nip 270, operation continues to step S1090. As discussed above, the data provided by the feedback loop is typically provided as a relative increase or decrease compared to an expected value of the kinetic property represented by the data. Therefore, in step S1090, the minimum, maximum, median, relative minimum, and relative maximum of the data values related to torque stored in the sample buffer array are calculated. According to various exemplary embodiments, these values are used to predict whether a multi-pick has occurred. The relative minimum is calculated according to the following relationship:

$$R_{min}=\tilde{x}-x_{min} \tag{2}$$

and the relative maximum is calculated according to the following relationship:

$$R_{max}=x_{max}-\tilde{x} \tag{3}$$

where $R_{min}$ is the relative minimum, $\tilde{x}$ is the median, $x_{min}$ is the minimum, $R_{max}$ is the relative maximum, and $x_{max}$ is the maximum.

Various exemplary embodiments of the invention use the relative minimum and the relative maximum because the median data value is considered to be related to the baseline amount of torque necessary to rotate the drum and the transfer roller. The torque required to pass any second sheet of media through the transfer nip 270 (i.e., during a multi-pick) is in addition to this baseline amount.

In various other exemplary embodiments, the mean of the data values may be substituted for the median. However, the size of a single large spike in the data values can skew the mean away from an accurate estimate of the baseline torque. The median is not substantially effected by the size of the spike in the same manner. Also, in various other exemplary embodiments, the actual maximum and minimum values may be used. In such embodiments, the feedback data would have to be expressed as a total value since the maximum and minimum will be a total values rather than relative to an estimated baseline.

Next, in step S1100, a determination is made whether the relative minimum is larger than the threshold value. The relative minimum may be larger than the threshold value when, for example, the drum 140 and/or transfer roller 150 travels down or "falls off" the trailing edge of an inked area. It is conceivable, immediately following this "falling off," that the drum 140 and/or transfer roller 150 may bounce back causing a ring in the feedback data. If the relative minimum is larger than the threshold value, operation continues to step S1110. If the relative minimum is not larger than the threshold value, operation jumps to step S1120.

In step S1110, the threshold value is reset equal to the relative minimum in order to account for the ring in the feedback data that may result from the ink thickness. This prevents any feedback ring from being considered a multi-pick. It should be appreciated that, in various other exemplary embodiments, in order to simplify the method, steps S1100 and steps S1110 may be omitted. As a result, according to such embodiments, it is only necessary to calculate the relative maximum, as opposed to both the relative maximum and relative minimum.

In step S1120, a determination is made whether the relative maximum is larger than the threshold value. If the relative maximum is larger than the threshold value, it is assumed that a multi-pick has occurred and operation jumps to step S1999. As discussed above, the threshold value reflects the expected amount of additional torque that might be required due to, for example, ink thickness or feedback ring. If the relative maximum value is larger than the threshold value than the additional torque is assumed to be the result of a multi-pick. In step S1999, a notification of a multi-pick is made and operation of the method terminates.

However, in step S1120, if the relative maximum is not greater than the threshold value, it is assumed that there has not been a multi-pick and operation continues to step S1130. In step S1130, the oldest feedback data entry is removed from the buffer array to make room for a next feedback data entry and a period of time substantially equal to the sample rate is allowed to pass (the actual time may vary depending on the execution times of the various method steps). As should be appreciated, data provided by the feedback loop can again be sampled, because the buffer array is no longer full. Operation returns to step S1060.

Figure 5:
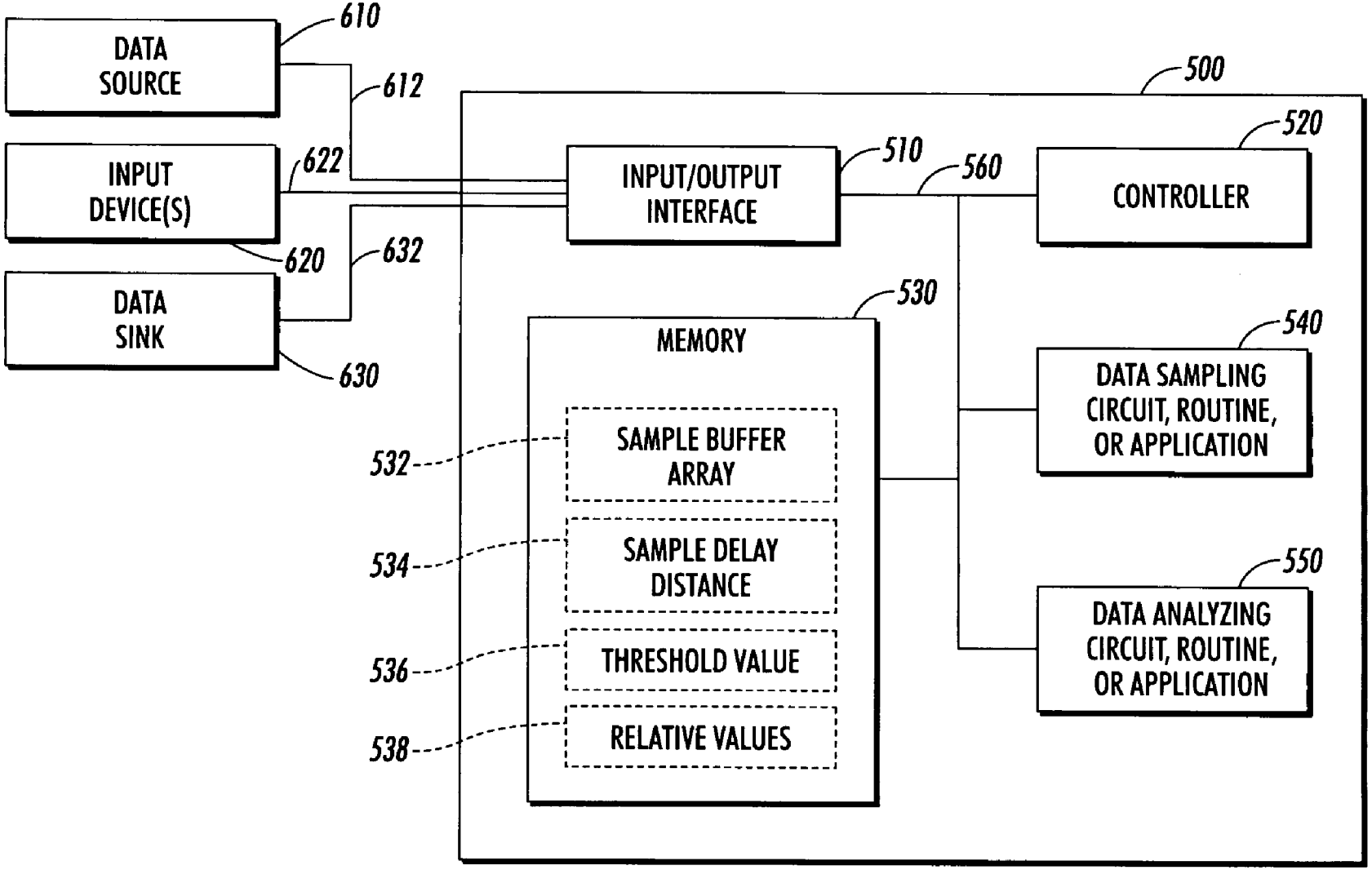
FIG. 5 is a functional block diagram of an exemplary embodiment of a system for detecting a multi-pick according to the invention.

FIG. 5 is a functional block diagram of an exemplary embodiment of a system for detecting a multi-pick according to the invention. As shown in FIG. 5, the system 500 includes an input/output interface 510, a controller 520, a memory 530, a data sampling circuit, routine, or application 540, and a data analyzing circuit, routine, or application 550, each appropriately interconnected by one or more data/control busses and/or application programming interfaces 560, or the like.

The input/output interface 510 is connected to a data source 610 over one or more links 612. The data source 610 can be any device capable of providing data usable to detect a multi-pick to the input/output interface 510 of the system 500. Such data could include, for example, drum servomotor feedback data, drum servo electrical current data, or any other data relating to the kinetic properties of one or more rollers that form a nip within a media feed mechanism. The data source 610 may include, for example, the controller of an image forming device, or any other element of a media feed mechanism responsible for monitoring and/or recording the kinetic properties of one or more rollers that form a nip within a media feed mechanism and/or monitoring, supplying, and/or recording all or part of the electrical flow within the a media feed mechanism.

The input/output interface 510 is connected to one or more input devices 620 over one or more links 622. The input device(s) 620 can be any device suitable for providing input, for example, data, control signals, and/or user defined values, to the input/output interface 510 of the system 500. The input device(s) 620 may include one or more of a keyboard, a mouse, a track ball, a track pad, a touch screen, a personal computer, a client or a server of a wired or wireless network, an intranet, an extranet, a local area network, a wide area network, a storage area network, the Internet (especially the World Wide Web), or any other known or later-developed device for inputting data, control signals, and/or user defined variables to the system 500.

The input/output interface 510 is connected to a data sink 630 over one or more links 632. The data sink 630 can be any device capable of using, processing, and/or storing data provided by the input/output interface 510 of the system 500 indicating that a multi-pick has occurred. The data sink 630 may include, for example, the controller of a media feed mechanism or an image reproduction device, or any other element of a media feed mechanism or an image reproduction device responsible for monitoring the operational properties and/or status of a media feed mechanism or an image reproduction device. The data sink 630 may also include a locally or remotely located laptop or personal computer, a client or a server of a wired or wireless network, an intranet, an extranet, a local area network, a wide area network, a storage area network, the Internet (especially the World Wide Web), or any other known or later-developed device that might be responsible for monitoring the operational properties and/or status of a media feed mechanism or an image reproduction device.

Each of the various links 612, 622, and 632 can be implemented using any known or later-developed device or system for connecting the data source 610, the input device(s) 620, the and/or the data sink 630, respectively, to the input/output interface 510. In particular, the links 612, 622, and 632 can each be implemented as one or more of a direct cable connection, a connection over a wide area network, a local area network, a connection over an intranet, a connection over an extranet, a connection over the Internet, a connection over any other distributed processing network or system, or an infrared, radio-frequency, or other wireless connection.

As shown in FIG. 5, the memory 530 contains an number of different memory portions, including a sample buffer array portion 532, a sampling delay distance portion 534, a threshold value portion 536, and a relative values portion 538. The sample buffer array portion 532 stores the framework for, and the values contained in, the sample buffer array. The sampling delay distance portion 534 stores the sampling delay distance. The threshold value portion 536 stores the threshold value. The relative values portion 538 stores the calculated relative minimum and relative maximum.

The memory 530 shown in FIG. 5 can be implemented using any appropriate combination of alterable, volatile or non-volatile memory or non-alterable, or fixed, memory. The alterable memory, whether volatile or non-volatile, can be implemented using any one or more of static or dynamic RAM, a floppy disk and disk drive, a writeable or re-writeable optical disk and disk drive, a hard drive, flash memory or the like. Similarly, the non-alterable or fixed memory can be implemented using any one or more of ROM, PROM, EPROM, EEPROM, an optical ROM disk, such as CD-ROM or DVD-ROM disk, and disk drive or the like.

The data sampling circuit, routine, or application 540 accesses or inputs data provided by the data source 610 via the input/output interface 510 and outputs data values sampled at a given sample rate. The data analyzing circuit, routine, or application 550 accesses or inputs a predetermined number of data values and outputs the relative minimum and relative maximum of the data values and/or compares the data values.

In operation, system 500, may input one or more preliminary values from either the data source 610 or input device(s) 620 representing the size of the sample buffer array, the sampling delay distance, and/or the threshold value. In this case, the values are input across links 612 and/or 622 via the input/output interface 510 and, under control of the controller 520, respectively stored in the sample buffer array portion 532, the sampling delay distance portion 534, and the threshold value portion 536. Alternatively, if one or more of the values is not provided by either of the data source 610 or the input device(s) 620, one or more of the values may already be stored in the corresponding portion of the memory 530 as a default value. In various other exemplary embodiments, preset values for the size of the sample buffer array, the sampling delay distance, and/or the threshold value may be permanently stored in the respective portions of the memory 530 and thus not provided by either of the data source 610 or input device(s) 620.

Once the size of the sample buffer array, the sampling delay distance, and the threshold value are stored in the respective portions of the memory 530, the system 500 inputs a data stream representing a value recorded and/or monitored by the data source that reflects the torque required to rotate either one or both of the rollers that form a nip across link 612 to the input/output interface 510. Under control of the controller 520, the data sampling circuit, routine, or application 540 accesses the input data stream and the sampling delay distance from the sampling delay distance portion 534 and allows a portion of the data stream representing the sampling delay distance to pass.

Then, under control of the controller 520, the data sampling circuit, routine, or application 540 accesses the sample buffer array size from the error sample buffer array portion 532 and begins sampling values from the stream at a given sample rate. Under control of the controller 520, the data sampling circuit, routine, or application 540 outputs the sampled values to the sample buffer array portion 532 of the memory 530 until the sample buffer array is full.

Once the sample buffer array is full, under control of the controller 520, the data analyzing circuit, routine, or application 550, accesses the data stored in the sample buffer array portion 532 and calculates the relative maximum and relative minimum. Under control of the controller 520, the data analyzing circuit, routine, or application 550 stores the relative maximum and relative minimum in the relative values portion 538 of the memory 530.

Under control of the controller 520, the data analyzing circuit, routine, or application 550 accesses the relative maximum and relative minimum in the relative values portion 538 and the threshold value from the threshold value portion 536. If the relative minimum is greater than the threshold value, under control of the controller 520, the data analyzing circuit, routine, or application 550 stores the relative minimum value in the threshold value portion 536 of the memory 530. If the relative maximum is grater than the threshold value, under control of the controller 520, the data analyzing circuit, routine, or application 550 outputs a notification that a multi-pick has occurred and/or a stop command via the input/output interface 510 across link 632 to the data sink 630. As a result of the multi-pick notification and/or a stop command, the data stream will no longer be input.

Next, under control of the controller 520, the data sampling circuit, routine, or application 540, assuming it has maintained access to the data stream, samples another value from the data stream at the predetermined sample rate. Under control of the controller 520, the sampled value is stored in the sample buffer array portion 532 and the oldest value stored in the sample buffer array portion 532 is discarded. Each time a new value is stored in the sample buffer array portion 532, under control of the controller 520, the data analyzing circuit, routine, or application 550 will access the data stored in the sample buffer array portion 532 recalculate the relative maximum and relative minimum and compare them to the threshold value.

As mentioned above, the data sampling circuit, routine, or application 540, under control of the controller 520, will continue to sample the data at the predetermined sample rate as long as it has access to the data stream. As such, when the data source 610 has determined that there is little likelihood of a multi-pick occurring (e.g., the media sensor is set to false) the data source 610 will no longer supply the data stream to the system 500. Alternatively, the data source may input a stop command across link 612 via the input/output interface to the controller 520.

It should be appreciated that, depending on cost or other design constraints, one or more of the above-described elements of the system 500 may be combined into a single element or divided into multiple elements where appropriate. For example, where appropriate the controller, the data sampling circuit, routine, or application 540, and/or the data analyzing circuit, routine, or application 550 may be combined into a single circuit, routine, or application or divided into multiple circuits, routines, or applications.

According to the above-described exemplary embodiments, it is possible to detect a multi-pick within a nip, without the need for additional devices dedicated solely to the detection of multi-picks. Because servomotors already provide a data stream related to one or more kinetic properties of the roller that the servomotor controls, a controller can compare the kinetic properties of the roller to a preset limit to determine whether or not a multi-pick has occurred, without utilizing any devices dedicated solely to detecting multi-picks. Such embodiments also prevent a stripper blade from remaining down such that the blade becomes contaminated with ink that might be re-deposited on subsequent sheets of media.

While this invention has been described in conjunction with the exemplary embodiments outlined above, various alternatives, modifications, variations, and/or improvements may be possible. Accordingly, the exemplary embodiments of the invention, as set forth above, are intended to be illustrative. Various changes may be made without departing from the spirit and scope of the invention.

What is claimed is:

1. A method for detecting a multi-pick of sheets of a media in a nip of a media feed mechanism, comprising:

determining a limit of a property of the media feed mechanism that is related to at least one kinetic property of one or more rollers that form a nip and are driven by a motor to rotate in a first direction (media feed direction), or are not driven, wherein the media feed mechanism feeds all the multi-picked sheets of the media in the first direction, and the kinetic property includes at least one of a rotational displacement, a torque, a force, an acceleration, a speed, and an energy required to produce at least one of the torque, the acceleration, the speed and the rotational displacement, monitoring the property of the media feed mechanism; and determining, if the monitored property exceeds the limit, that the multi-pick has occurred.

2. The method of claim 1, further comprising delaying the monitoring of the property for a predetermined amount of time.

3. The method of claim 2, wherein the predetermined amount of time is related to a predetermined distance that a sheet of media travels through the nip.

4. The method of claim 3, further comprising preventing the multi-pick for at least the predetermined distance.

5. The method of claim 4, wherein preventing a multi-pick for at least the predetermined distance, comprises preventing the multi-pick for at least the predetermined distance with a scraper or finger.

6. The method of claim 1, wherein monitoring the property of the media feed mechanism comprises monitoring the property of the media feed mechanism by sampling values representing the property of the media feed mechanism at a predetermined sample rate.

7. The method of claim 6, wherein monitoring the property of the media feed mechanism by sampling values representing the property of the media feed mechanism at the predetermined sample rate comprises sampling the values until a predetermined number of sampled values have been sampled.

8. The method of claim 7, wherein sampling the values until the predetermined number of sampled values have been sampled comprises storing the predetermined number of samples in a sample buffer array.

9. The method of claim 8, wherein, if the monitored property does not exceed the operational limit, the oldest sampled value stored in the sample buffer array is discarded, and a new sampled value is added to the sample buffer array.

10. The method of claim 6, further comprising:

determining a maximum value of the of the monitored property; and comparing the maximum value to the limit;

wherein determining, if the monitored property exceeds the limit, that the multi-pick has occurred comprises determining, if the maximum value exceed the limit, that a multi-pick has occurred.

11. The method of claim 10, wherein determining the maximum value of the monitored property comprises selecting the maximum sampled value from the sampled values.

12. The method of claim 10, wherein determining the maximum value of the monitored property comprises:

determining a median of the sampled values;

determining a maximum sampled value; and determining the maximum value of the monitored property as a relative maximum, wherein the relative maximum is the difference between the maximum sampled value and the median of the sampled values.

13. The method of claim 10, wherein determining the maximum value of the monitored property comprises:

determining a mean of the sampled values;

determining a maximum sampled value; and determining the maximum value of the monitored property as a relative maximum, wherein the relative maximum is the difference between the maximum sampled value and the mean of the sampled values.

14. The method of claim 1, further comprising determining a minimum value of the of the monitored property, wherein if the minimum value of the monitored property is more than the limit, the limit is set equal to the minimum value.

15. The method of claim 1, wherein the at least one kinetic property is a torque required to drive the one or more of the rollers that form the nip.

16. The method of claim 1, wherein the property of the media feed mechanism is servo following error.

17. A system for detecting a multi-pick of sheets of a media, comprising:

at least one controller that:

accesses a data stream containing values representing kinetic properties of one or more rollers that form a nip and are driven by a motor to rotate in a first direction (media feed direction), or are not driven, and outputs sampled values that are sampled from the data stream at a predetermined sampling rate, wherein the rollers feed all the multi-picked sheets of the media in the first direction, and the kinetic property includes at least one of a rotational displacement, a torque, a force, an acceleration, a speed, and an energy required to produce at least one of the torque, the acceleration, the speed and the rotational displacement; and accesses the sampled values, analyzes the sampled values, and determines whether a multi-pick has occurred.

18. The system of claim 17, wherein the at least one controller determines a maximum value of the sampled values and compares the maximum value to a predetermined limit.

19. The system of claim 18, wherein if the maximum value exceeds the predetermined limit, the at least one controller determines that a multi-pick has occurred.

20. The system of claim 17, wherein the at least one controller determines a relative maximum value of the sampled values and compares the relative maximum value to a predetermined limit.

21. The system of claim 20, wherein if the relative maximum value exceeds the predetermined limit, the at least one controller determines that a multi-pick has occurred.

22. A media feed mechanism including the system of claim 17.

23. An image forming device including the media feed mechanism of claim 22.

24. The image forming device of claim 23, wherein the image forming device is a xerographic marking device.

25. A storage medium storing a set of program instructions executable on a data processing device and usable for detecting a multi-pick of sheets of a media in a nip of a media feed mechanism, the set of program instructions comprising:

instructions for determining a limit of a property of the media feed mechanism that is related to kinetic properties of one or more rollers that form a nip and are driven by a motor to rotate in a first direction (media feed direction), or are not driven, wherein the media feed mechanism feeds all the multi-picked sheets of the media in the first direction, and the kinetic property includes at least one of a rotational displacement, a torque, a force, an acceleration, a speed, and an energy required to produce at least one of the torque, the acceleration, the speed and the rotational displacement;

instructions for monitoring the property of the media feed mechanism; and instructions for determining, if the monitored property exceeds the operational limit, that a multi-pick has occurred.

* * * * *